United States Patent [19]

Zublin

[11] 4,442,899

[45] Apr. 17, 1984

[54] HYDRAULIC JET WELL CLEANING ASSEMBLY USING A NON-ROTATING TUBING STRING

[75] Inventor: Casper W. Zublin, Bakersfield, Calif.

[73] Assignee: Downhole Services, Inc., Bakersfield, Calif.

[21] Appl. No.: 337,371

[22] Filed: Jan. 6, 1982

[51] Int. Cl.[3] ..... E21B 37/00; B08B 9/02

[52] U.S. Cl. ..... 166/312; 166/222; 239/255; 239/DIG. 13; 134/167 C; 134/179

[58] Field of Search ..... 166/312, 311, 223, 222, 166/72, 73, 67, 177, 171, 379, 378; 175/422; 299/17, 16; 239/251, 252, 255, 256, 261, DIG. 13; 134/167 C, 168 C, 176, 179, 198

[56] References Cited

U.S. PATENT DOCUMENTS

| | | | |
|---|---|---|---|
| 2,735,794 | 2/1956 | Pletcher | 239/DIG. 13 |
| 3,994,310 | 11/1976 | Brandon | 134/167 C |
| 4,164,325 | 8/1979 | Watson | 239/DIG. 13 |

*Primary Examiner*—Stephen J. Novosad
*Assistant Examiner*—Hoang C. Dang
*Attorney, Agent, or Firm*—Knobbe, Martens, Olson & Bear

[57] ABSTRACT

A method and system for cleaning well liners employing a non-rotating tubing string attached to a hydraulic jet carrier assembly is disclosed. The assembly has a plurality of jet nozzles spaced along its length, each of said nozzles expelling a stream of fluid under pressure against the liner with a force which has an equal and opposite reactive force. The nozzles are oriented along the carrier such that the reactive force for each jet is directionally offset with respect to the central axis of the carrier, thereby creating a twisting moment tending to rotate the carrier about its central axis. During the cleaning operation, the bottom hole differential pressure of the fluid supplied to the jet carrier is varied to rotationally oscillate the carrier as it is moved vertically within the well bore to increase the coverage of the fluid streams on the liner.

16 Claims, 5 Drawing Figures

Fig. 1
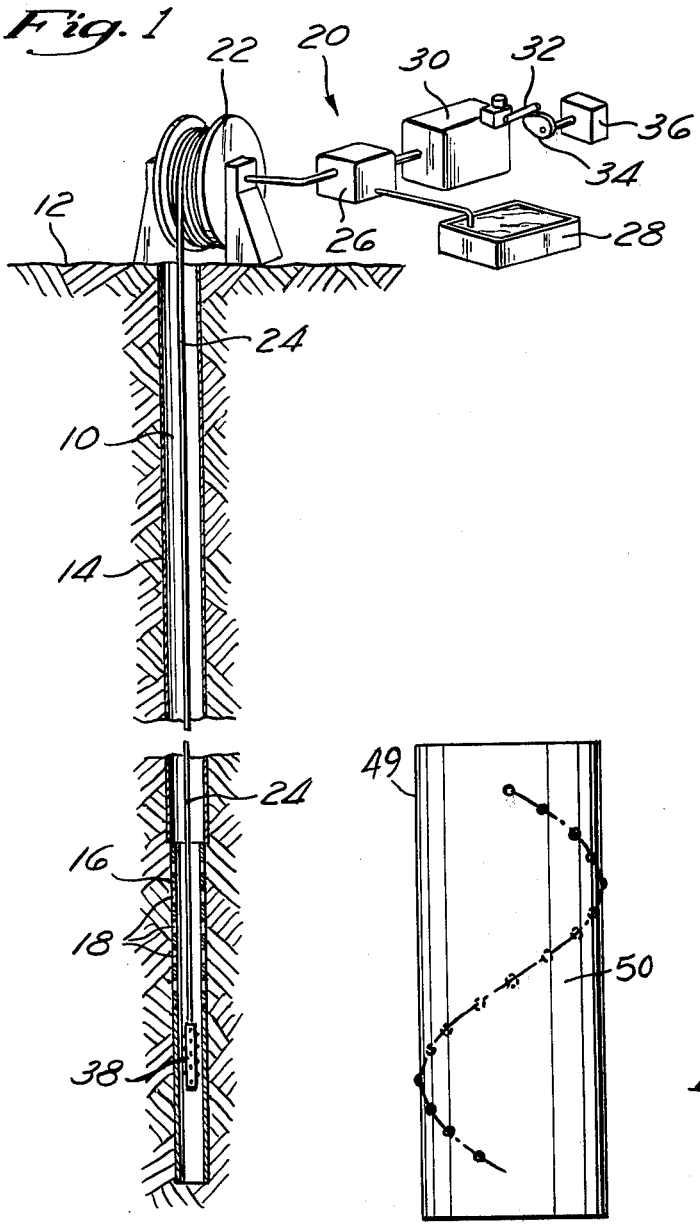
Fig. 2
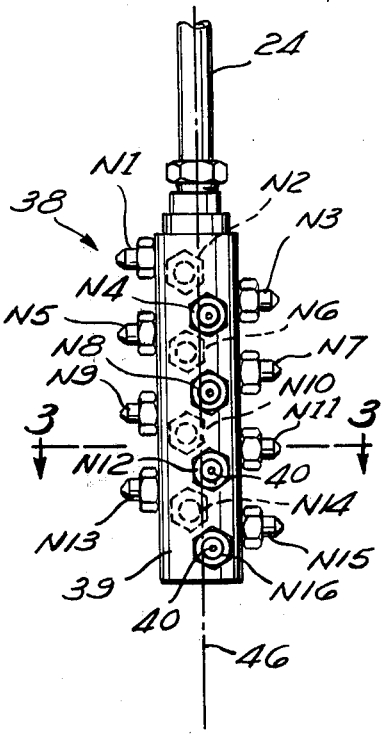
Fig. 4
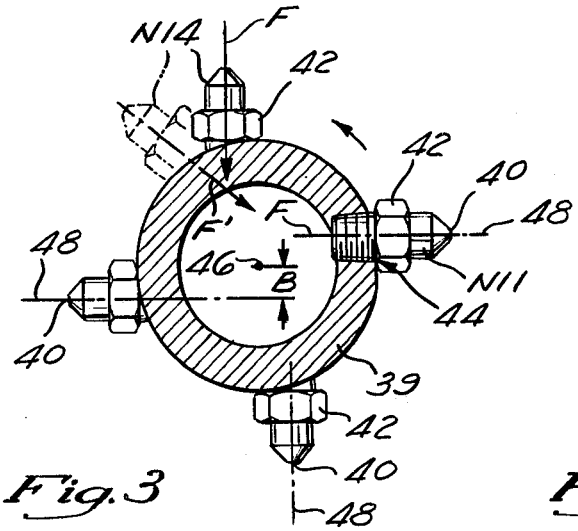
Fig. 3
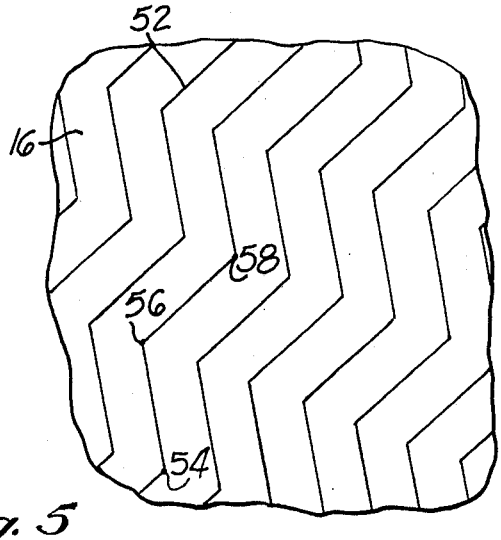
Fig. 5

HYDRAULIC JET WELL CLEANING ASSEMBLY USING A NON-ROTATING TUBING STRING

BACKGROUND OF THE INVENTION

The invention is specifically directed to a method and system for cleaning perforated, slotted and wire wrapped well liners which become plugged with foreign material by means of devices using high velocity liquid jets. Specifically, a method and system is employed with a tubing string that is non-rotating. It will be understood that in certain instances the inventive method and system can be applied to cleaning pipes in general and as used herein the term "pipe" shall include well liners.

In the well producing art, it is customary to complete wells, such as water, oil, gas, injection, geothermal, source, and the like, by inserting a metallic well liner adjacent a fluid-producing formation. Openings in the well liner provide passage-ways for flow of fluids, such as oil or water and other formation fluids and material from the formation into the well for removal to the surface. However, the openings, which, for example, may be slots preformed on the surface or perforations opened in the well, will often become plugged with foreign material, such as products of corrosion, sediment deposits and other inorganic or hydrocarbon complexes.

Since removal and replacement of the liner is costly, various methods have been developed to clean plugged openings including the use of jetted streams of liquid. The use of jets was first introduced in 1938 to directionally deliver acid to dissolve carbonate deposits. In about 1958 the development of tungsten carbide jets permitted including abrasive material in a liquid which improved the ability of a fluid jet to do useful work. However, the inclusion of abrasive material in a jet stream was found to be an ineffective perforation cleaning method in that it enlarged the perforation which destroyed the perforation sand screening capabilities.

More recently, Chevron Research Company, disclosed a method and apparatus for directionally applying high pressure jets of fluid to well liners in a number of U.S. patents. These patents are U.S. Pat. Nos. 3,720,264, 3,811,499, 3,829,134, 3,850,241, 4,088,191 which are herein incorporated by reference.

The assignee of the subject application developed a cleaning operation and device pursuant to the Chevron disclosures. The system employed a jet carrier of about six feet in length, having eight jet nozzles widely spaced along its length. The nozzles were threadably mounted on extensions which were in turn welded to the jet carrier. The jet carrier was attached to a tubing string that could be vertically reciprocated and horizontally rotated within the well bore. As the carrier was moved vertically and rotated adjacent the liner, the nozzles directed jet streams which contacted and cleaned the liner. This design developed a number of problems one of which was that there was no known relationship between the vertical and rotational speed which would assure efficient and complete liner coverage by the fluid streams.

In an attempt to solve these problems, Applicant developed its own jet carrier assembly fully described in co-pending application, Ser. No. 195,303, filed Oct. 7, 1980, now U.S. Pat. No. 4,349,073, which is herein incorporated by reference. This assembly has between about 8 and 16 nozzles spaced along its length. An equation is used to determine the jet stream track pattern against the liner for a jet tool having a given nozzle number and spacing and which is rotated and moved vertically at selected speeds. The spacing between the tracks is then calculated from this track pattern. Comparing the spacing with the known width of a jet stream determines the amount of coverage the streams provide on the liner. Using this equation, a set of rotational and vertical speed of a constant ratio were determined which would provide jet streams having theoretical double coverage over all points on the liner when using 16 nozzles.

Although the design was a major advance in the art, it did not attempt to relate the rotational and vertical speeds to the diameter of the liner. To solve this problem, Applicant developed a system in which the energy needed to clean the liner is determined and related to the factors which the operator can control in the field. After determining the energy needed to clean the liner, the power drop between the nozzle and the liner is calculated as a dependency of the stand-off distance, ie. the distance of the jet from the liner. Knowing the power drop, one can determine the total energy of the streams at the nozzles needed to produce the required cleaning energy at the liner. The rotational speed and maximum vertical speed are then calculated which will produce this total energy for a given liner size and given plugging condition. This system is fully disclosed in co-pending application Ser. No. 308,582 filed Oct. 5, 1981 which is herein incorporated by reference.

Although Applicant's systems described above are quantum advances in the art of well cleaning, they employ a high pressure rotating swivel, which is, in turn, rotatably connected to a tubing string. The fact that the tubing string is freely rotatable permits rotation of the carrier at speeds which ensure complete liner coverage by the jet streams as the carrier is moved vertically. In short, these carriers are not applicable to non-rotating tubing strings.

A safe and economically efficient alternative to jointed tubing or conventional rig is the coiled tubing rig. In general, coil tubing is a continuous string of small diameter tubing that can be run into the well from a large reel without the necessity of making joint connections. This operation, therefore, saves rig time and is usually more economical to employ. Many workover operations can be completed quickly and efficiently by using coiled tubing instead of the convention rigs. Theoretical burst pressures of typical coiled tubing are on the order of between 11,400 psi and 14,500 psi. This is well below the operating pressures for hydraulic jet cleaning.

The problem with employing coiled tubing rigs with hydraulic jet well cleaning is that because the coiled tubing is wound on a reel, the tubing string is not rotatable in the conventional manner such as by rotating swivel. Applicant is not aware of any hydraulic jet well cleaning operations employing non-rotating tubing strings such as formed of coiled tubing. A "non-rotating" tubing string as used herein shall mean a string which is not conveniently rotatable.

As a result, a strong need exists for a method and system for cleaning well liners which can be employed with non-rotating tubing strings and which will clean the particular foreign material present in a controllable, economical field operation.

SUMMARY OF THE INVENTION

The inventive method and system employs a non-rotating tubing string which is attached to a jet carrier having a central axis and a plurality of nozzles spaced along its length, each nozzle expelling a stream of fluid under pressure against the liner with a force which has an equal and opposite reactive force.

The nozzles are oriented on the carrier such that the reactive force is directionally offset from the carrier's axis, creating a twisting moment or torque about the axis, tending to angularly displace the carrier. This displacement angle is dependent upon the length of tubing, the torsional modulus of elasticity of the tubing, the inside and outside diameter of the tubing, the amount of offset of the reactive force, the diameter of the jet nozzle orifice, the number of jet nozzles and the differential bottom hole pressure of the water.

For a given operation at a given depth within the well bore, the displacement angle is dependent upon the differential bottom hole water pressure only, all other parameters being fixed. Changing the pressure changes this angular displacement. Thus, by alternating the pressure between two values, the carrier will oscillate between two displacement angles which increases the area on the liner covered by the fluid streams. During the cleaning operation the carrier is moved vertically along the well bore while the pressure is cycled producing fluid stream coverage which removes the foreign material.

The inventive method avoids the inefficiency in both time and resources of using conventional rotating rigs by permitting the use of non-rotating tubing strings in an efficient and effective cleaning operation.

This significant advance in the art will be clarified and discussed in the following section with reference to the following drawings, in which:

FIG. 1 is an elevation view partially in section, illustrating a jet carrier assembly within a well bore attached to a non-rotating tubing string;

FIG. 2 is a side view of a jet carrier assembly, showing a particular nozzle configuration;

FIG. 3 is a sectional view taken through line 3—3 of FIG. 2;

FIG. 4 is a side view of a jet carrier assembly, illustrating another embodiment of a jet nozzle configuration with the nozzle locations shown as points;

FIG. 5 is a schematic illustration of the track pattern of the jet streams against the well liner produced by the nozzle configuration shown in FIG. 4.

DETAILED DESCRIPTION OF THE PREFERRED EMBODIMENT

Referring to FIG. 1, a well 10 is shown drilled into the earth's surface 12. The upper portion of the well 10 is cased with a suitable string of casing 14. A liner 16 having openings 18 is hung from the casing 14 and extends along the producing formation. The openings 18, which may be slots or perforations, permits flow of the formation fluids from the formation into the interior of the well 10. As the formation fluids are produced, the openings 18 in the slotted liner 16 tend to become plugged by depositions of scale, hydrocarbons, clay and sand. The plugging material in the various slots will vary in composition and depending upon the composition will be more or less difficult to remove. As the slots become plugged, production from the well declines. Once it has been determined that the openings 18 in the well liner 16 have become plugged to the extent that cleaning is required for best operation of the well, a hydraulic jet cleaning apparatus 20, shown schematically in FIG. 1, is assembled to accomplish such cleaning.

The apparatus 20 includes a reel 22, around which is wound a tubing string 24. The tubing string is non-rotating, since it is wound around the reel 22. An example of such a tubing string is coiled tubing which is a continuous string of small diameter steel tubing commonly having a $\frac{3}{4}$ inch, 1 inch or $1\frac{1}{4}$ inch diameter. The theoretical burst pressures of coiled tubing having these dimensions are 12,900 psi, 14,500 psi and 11,400 psi, respectively. The tubing string 24 extends into a jet carrier assembly 38 adjacent the slotted liner 16.

A pump 26 provides the tubing string 24 with a fluid under high pressure obtained from a fluid reservoir 28. The fluid is commonly water which may be mixed with chemical additives. The fluid travels down the tubing string 24 to the jet carrier assembly 38, from which it is jetted. The pump 26 is powered by an engine 30 having a throttle 32 which controls the speed of the engine. The throttle 32 is, in turn, connected through a cam mechanism 34 with a timer 36.

Referring to FIG. 2, an example of a jet carrier assembly 38 which can be employed in the inventive method and system is shown in a side elevational view. As will become clear, jet carriers having different nozzle numbers and spacing along the carrier 38 may be used. The tubing string 24 threadably engages the upper portion of the carrier 38 to form a water-tight seal therebetween.

The jet carrier 38 has an exterior body 39 which has a fluid channel running therethrough for passage of the high pressure fluid supplied by the pump 26. The carrier 38 is coaxial with respect to the tubing string 24 and has an axis 46 which runs through the center of the carrier 38.

The carrier 38 has nozzles N1 through N16 spaced along the length of the body 39, each having a jet orifice 40. Each of the nozzles N1 through N16 is threaded into a hexagonally-shaped adapter labeled generally as 42. The adapters 42 are in turn threadably mounted within adapter seats, labeled generally as 44 shown in FIG. 3. A more detailed description of the precise structure and engagement of the nozzles N1 through N16 with the adapters 42 is given in co-pending application Ser. No. 195,303.

The nozzles N1 through N16 can be conceptualized as forming four sets of four nozzles, each set of four being spacially located about the exterior body 39 of the carrier 38, to form a spiral. Each set of four nozzles is circumferentially spaced from each other about 90°. Thus, as shown in FIG. 3, nozzles N11, N12, N13 and N14 are circumferentially spaced about 90°. Referring to FIGS. 2 and 3, the nozzles N1, N2, N3, N4 form the first spiral, nozzles N5, N6, N7, and N8 form a second spiral, nozzles N9, N10, N11, and N12 form a third spiral, and nozzles N13, N14, N15, and N16 form a fourth spiral.

As shown in FIG. 3, each nozzle, N1 through N16 can be conceptualized as having a central axis 48 extending through the jet orifice 40. The axis 48 for each nozzle N1 through N16 is offset a distance labeled B in FIG. 3 from the axis 46 of the carrier 38. Distance B is the perpendicular distance between the carrier axis 46 and the nozzle axis 48. The nozzles N1 through N16 have been located so that the offset distance B of each nozzle is equal.

During a cleaning operation, high pressure fluid is pumped down the tubing string 24 at bottom hole differential pressures of between about 6500 and 8000 psi. It will be understood that the pressure of the fluid at the hole bottom may differ from the pressure of the fluid at the pump 26. However, given the pressure of the fluid at the pump 26, the bottom hole differential pressure can be calculated by one of ordinary skill in the art. The fluid will be jetted out of the nozzle orifices 40 from the nozzles N1 through N16. The fluid under high pressure will exert a force against the liner 16 which removes the foreign material which plugs the perforations 18. This fluid force against the liner has an equal and opposite reactive force F, which is directed along the axis 48 in a direction toward the center of the carrier 38. A typical force vector labeled F is shown in FIG. 3, having a direction shown by the arrow. Since the reactive force is directed along the nozzle axis 48 the force is offset from the central axis 46 of the carrier 38 the distance B.

The reactive force F, which is equal and opposite to the force of the water through the orifice 40, is given by the following equation:

$$F=P\times A$$

wherein,

P=the bottom hole differential pressure of the water in psi;

A=the cross-sectional area of the jet orifice.

As an example, if the bottom hole differential pressure of the water is 7238 psi and the diameter of the jet orifice $D_j$ is 0.0325 inches in diameter the reactive force for a single nozzle will be as follows:

$$F=(7238)(3.14)(0.0325/2)^2=6 \text{ lbs.}$$

The force F creates a torque, T, about the carrier 38 tending to rotate the carrier in a counter clockwise direction as shown by the small arrow in FIG. 3.

The value of the torque created by each nozzle is given by the following equation:

$$T=F\times B$$

wherein,

T=the twisting moment or torque in in.-lbs;

F=the reactive force for each nozzle in lbs.;

B=the offset distance of the reactive force from the carrier axis in inches.

Using the equation above, one can calculate the torque for a single jet. For example, if the reactive force for each nozzle is 6 pounds, and the distance B is one inch, then the torque is calculated as follows:

$$T = 6 \text{ lbs.} \times 1 \text{ inch} = 6 \text{ in.-lbs.} = .5 \text{ ft.-lbs.}$$

It should be understood that each of the nozzles creates a torque that tends to rotate the carrier 38 in a counter clockwise direction. This is true because the force for each nozzle is acting upon the same side of an imaginary lever arm through the axis 46 of the carrier 38. If desired, for any reason, the nozzles, N1 through N16, could be oriented differently on the body of the carrier 38 so that some of the reactive forces would produce a torque tending to rotate the carrier in a clockwise direction. For example, shown in FIG. 3 is a phantom view of the nozzle N14 tilted somewhat in its position on the carrier 38, so that its reactive force, F', would tend to create a torque in a clockwise direction. However, in the preferred embodiment, the reactive forces all create a torque in the same direction. Moreover, as discussed above, in the preferred embodiment, the distance B for each nozzle is equal. Therefore, the total torque created by all of the jets can be calculated by multiplying the torque for one jet by the number of jets. Thus, in the preferred embodiment, having 16 nozzles and assuming the torque value per nozzle calculated above, the total torque for all nozzles would be as follows:

$$T(\text{total})=0.5 \text{ ft.-lbs.}\times 16 \text{ nozzles}=8 \text{ ft.-lbs.}$$

The total torque of all of the nozzles N1 through N16 will tend to rotate the carrier 38 and tubing string 24 until the total torque is counterbalanced by the inherent resistance of the tubing string 24 to such twisting. This resistance, or back torque, is a function of the torsional modulus of elasticity of the material comprising the tubing string.

The amount of rotation produced by the total torque, i.e., the angular displacement "a", can be calculated by using the following equation:

$$a=584\text{Tl}/(D^4-d^4)\text{G}$$

wherein,

T=the twisting moment in in.-lbs.;

l=the length of the tubing in inches;

D=the outside diameter of the tubing in inches;

d=the inside diameter of the tubing in inches;

G=the torsional modulus or elasticity.

The above equation is a standard equation taken from Machinery's Handbook 20th Edition, Industrial Press 1976.

For a given embodiment, the outside diameter and inside diameter of the tubing and the torsional modulus of elasticity will be a constant. The variables effecting the amount of angular displacement will therefore be the length of the tubing and the twisting moment. The twisting moment is dependent upon the pressure of the water and the number of nozzles since the area of the jet orifice can be considered to be a constant and in the preferred embodiment the distance B is a constant for all of the nozzles. In short, the parameters which are variables in the field are the length of the tubing, i.e. the depth of the cleaning operation, the number of nozzles and the pressure. As an example, assume the following:

$P=5{,}000$ psi $A=(3.14)(0.0325/2)^2$ $B=1''$ $l=5{,}000'$ $D=1.25''$ $d=1.082''$ $G=11{,}500{,}000$ psi N=the number of nozzles=16

The angular displacement, a, using the above equation with these values is 180 degrees.

For a given bottom hole differential pressure, depth and number of jets, an angular displacement can be calculated. The following is a chart providing the angular displacements for various values of pressure, jet numbers and tubing depth.

| PSI | No. of Jets | Twisting Moment | Depth (1) | Degrees Displaced | Depth (1) | Degrees Displaced |
|---|---|---|---|---|---|---|
| 5000 | 16 | 66 | 5000 | 188° | 8000 | 301° |
| 6000 | " | 80 | " | 227° | " | 364° |
| 6500 | " | 86 | " | 245° | " | 392° |
| 7000 | " | 93 | " | 265° | " | 424° |
| 7500 | " | 100 | " | 284° | " | 456° |
| 8000 | " | 106 | " | 302° | " | 483° |
| 6000 | 14 | 70 | 5000 | 199° | 8000 | 319° |
| 6500 | " | 75 | " | 214° | " | 342° |
| 7000 | " | 81 | " | 231° | " | 369° |
| 7500 | " | 87 | " | 248° | " | 396° |
| 8000 | " | 93 | " | 265° | " | 424° |
| 6000 | 12 | 60 | 5000 | 171° | 8000 | 273° |
| 6500 | " | 65 | " | 185° | " | 296° |
| 7000 | " | 70 | " | 199° | " | 319° |
| 7500 | " | 75 | " | 214° | " | 342° |
| 8000 | " | 80 | " | 228° | " | 364° |

The above chart assumes:

Tubing $D=1.25''$, $d=1.082''$ $D_J=0.0325''$, $B=1''$

It should now be understood that for a given depth and number of jet nozzles, the twisting moment, T, and the angular displacement, a, can be varied by varing the pressure. For example, in the chart above if the pressure equals 7500 psi then the total torque produced by 16 nozzles will equal 100 ft.-lbs. This torque will produce a total angular rotation of the tubing of 284° at a depth 5,000 ft. If the bottom hole differential pressure is kept constant the tubing will remain twisted at this particular angle. However, if the pressure is increased to 8000 psi the total torque will be increased to 106 foot-pounds. This translates into a total angular displacement of 302°. Thus, if the water pressure is increased from 7500 to 8000 psi the tubing will have a net angular displacement of 18°. In the embodiment shown in FIG. 3 an increase in psi will increase the torque and create a net angular displacement in a counter clockwise direction.

If the pressure is then decreased to 7500 psi, the torque will decrease and the angular displacement will decrease a net 18° in the opposite (clockwise) direction. It should now be clear that if the pressure were cycled between 8000 and 7500 psi for example, the tubing would oscillate in alternating clockwise and counter clockwise directions 18°. Therefore, by varying the pressure, a continuing reciprocating rotational movement is produced.

In operation, to clean the liner 16, the jet carrier 38 is moved vertically up the wellbore while the value of the pressure is cycled. In order to cycle the pressure, the speed of the engine 30 which controls the pump 26 must be cycled. In order to cycle the speed of the engine 30, a timer 36 actuates a cam mechanism 34 which mechanically moves the engine throttle 32 as will be well understood by those of ordinary skill in the art. In this way the pressure is varied as the jet carrier 38 is moved vertically along the wellbore, creating a horizontal oscillation of the carrier.

The angular displacement of the oscillation can be controlled by reference to the chart given above by controlling the number of jet nozzles and the pressure.

It should be understood that as l changes during a cleaning operation, the angular displacement will change proportionally. Thus, when conditions warrant that calculation can be taken into account. For example with a total vertical cleaing interval of 100 ft. at a depth of 12,000 ft. the change in angular displacement will be negligible. However, with an interval of 1500 ft. at a depth of 5,000 ft. the change on angular displacement is significant.

It should be understood that the nozzle configuration shown in FIG. 2 is only one example of many configurations which could be employed in the inventive system. A second embodiment of a nozzle configuration is shown in FIG. 4. Referring to FIG. 4, a jet carrier 49 is shown having an exterior body 50. The position of each nozzle is represented by a point. Sixteen nozzle locations are shown in FIG. 4 forming one complete revolution, i.e., 360 degrees. Thus, the 16 nozzles form a single spiral about the exterior body 50 of the carrier 49. As the carrier 49 is moved vertically and oscillated by varying the pressure, the water will be jetted in streams against the liner 16 forming a particular track pattern on the face of the liner. This track pattern for the jet nozzle configuration shown in the embodiment of FIG. 4 is shown in FIG. 5.

Referring to FIG. 5, a portion of the well liner 16 is shown with a plurality of track patterns labeled generally 52. Each of the track patterns 52 is mutually parallel and spaced a given distance which will be dependent upon the width of the streams as they hit the liner 16, the angular displacement and the vertical speed of the carrier.

Each track for a given nozzle forms a generally zigzag pattern. Three of the points along one of the track patterns have been labeled 54, 56, and 58 respectively. The track segment between the point 54 and the point 56 is produced by the vertical movement of the carrier along with an angular displacement in a counter clockwise direction. By way of example, if at point 54 the pressure is increased 500 psi, the carrier will rotate 18 degrees. This angular displacement is transformed into the horizontal component of the segment between the point 54 and the point 56. The track segment between the point 56 and the point 58 represents the vertical movement of the carrier along with a pressure change producing rotation in a clockwise direction. By way of example, if at point 56 the pressure is decreased 500 psi, the carrier will rotate 18 degrees in a clockwise direction and this is transformed into the horizontal component of the segment between the point 56 and the point 58. Thus, the track pattern between the point 54 and the point 58 represents one full cycle of a pressure change.

In many applications prior to cleaning, conventional jointed tubing rig will already be in place within the wellbore. In using the inventive system, the non-rotating tubing string 24, will be lowered into the wellbore within the hollow center of the existing jointed tubing string. Thus, the carrier 38 and the tubing string 24 must be lowered until the carrier 38 extends below the existing jointed tubing string in order that the nozzles are clear to jet water against the liner. Due to this relationship, the distance between the jet carrier 38 and the liner 16 is larger than encountered with hydraulic jet-well cleaning using rotatable tubing strings as disclosed in pending Applications Ser. No. 195,303 filed Oct. 7, 1980, now U.S. Pat. No. 4,349,073, and Ser. No. 308,582 filed Oct. 5, 1981. In short, the standoff distance between the liner and the carrier is larger. As a result, it has been found advantageous to include high molecular weight long chain polymers as an additive in the water. In the hydraulic jet-well cleaning system disclosed by the Chevron Research Company in U.S. Pat. Nos. 3,720,264, 381,499, 3,850,241, 4,088,891 the standoff distance is given as approximately 6 to 10 times the diameter of the jet orifice. These polymers permit the standoff distance to be enlarged to 60 to 100 times the diameter of the jet orifice.

The addition of the long chain polymers, therefore, provides about a tenfold increase in the standoff distance. This is because the polymers provide a focusing effect of the jet streams. The polymers should be about 30 to 40 p.p.m. of the total fluid, but can vary significantly depending upon the exact polymer used. One polymer found satisfactory is marketed by Berkeley Chemical Research, Inc., P.O. 9264, Berkeley, Calif. 94709, under the trademark SUPER WATER.

I claim:

1. A system for washing pipes, comprising:
a non-rotating tubing string;
a jet carrier attached to said string having a generally tubular body with a hollow center which provides a path for a fluid, said body having a central axis;
nozzles mounted to said carrier body;
means for supplying fluid under pressure to said nozzles, each of said nozzles being adapted to expel said fluid against said pipe with a force against the pipe, said force having an equal and opposite reactive force, one or more of said nozzles being mounted in said carrier body such that said reactive force is directionally offset from said carrier axis creating a twisting moment about said axis tending to rotate said carrier about said axis;
means for vertically moving said carrier along the length of said pipe; and
means for alternating said pressure to oscillate said carrier as it moves vertically along said pipe to clean said pipe.

2. A system for washing pipes, comprising:
a non-rotating tubing string;
means for expelling a stream of fluid against said pipe, said expelling means being attached to said string;
means for supplying fluid under pressure to said expelling means;
means for creating a twisting moment tending to angularly displace said expelling means;
means for vertically moving said expelling means along said pipe; and
means for alternating said pressure to oscillate said expelling means as said expelling means moves along said pipe.

3. The system of claim 2 wherein said tubing in said tubing string is coiled tubing.

4. The system of claim 2 wherein a high molecular weight long chain polymer is added to said fluid.

5. A system for washing pipe comprising:
a non-rotating tubing string, said tubing in the string having a length, l, an outside diameter, D, an inside diameter, d, and a torsional modulus of elasticity, G,;
a jet carrier attached to said string having a central axis and a plurality of nozzles spaced along its length;
means for supplying fluid under pressure to said nozzles, said nozzles adapted to expel fluid in streams against said pipe, each of said streams striking said pipe with a force, said force having an equal and opposite reactive force, one or more nozzles being positioned on said carrier such that the reactive force is offset with respect to the axis of the carrier creating a twisting moment, T, tending to rotate the carrier through an angle, a, said angle being defined by the following equation:

$$a=584Tl/(D^4-d^4)G$$

wherein
T=twisting moment in inch-lbs;
l=length of tubing in inches;
D=outside diameter of tubing in inches;
d=inside diameter of tubing in inches;
G=Torsional modulus of elasticity;
means for vertically moving said carrier along the length of said pipe;
means for alternating said pressure to oscillate said carrier as it moves vertically along said pipe to clean said pipe.

6. A system for washing pipes comprising:
a non-rotating tubing string;
a jet carrier attached to said string having a central axis therethrough and having a plurality of nozzles spaced along its length;
means for supplying fluid under a bottom hole differential pressure, P, to said nozzles, said nozzles having orifices with an area, A, to expel said fluid in streams against said pipe, each of said streams striking said pipe with a force, said force having an equal and opposite reactive force, F, said reactive force being equal to P×A, one or more nozzles being oriented on said carrier such that the reactive force, F, is offset a distance, B, with respect to the axis of the carrier creating a twisting moment, T, equal to F×B tending to angularly displace the carrier;
means for vertically moving said carrier along the length of said pipe; and
means for alternating said pressure to oscillate said carrier as it moves vertically along the pipe to clean the pipe.

7. The system of claim 6 wherein said pressure, P, is greater than or equal to about 5,000 psi and less than or equal to about 8,000 psi.

8. The system of claim 6 wherein the number of said nozzles is no less than about 8 and no greater than about 16.

9. A system for washing pipes, comprising:
a non-rotating tubing string;
a jet carrier attached to said string having a central axis and having a plurality of nozzles spaced along its length;
means for supplying fluid under a bottom hole differential pressure, P, to said nozzles, said nozzles having orifices with an area, A, to expel said fluid in streams against said pipe, each of said streams striking said pipe with a force, said force having an equal and opposite reactive force, F, said reactive force being equal to P×A, one or more nozzles being oriented on said carrier such that the reactive force, F, is offset a distance, B, with respect to the axis of the carrier creating a twisting moment, T, equal to F×B tending to rotate the carrier through an angle, a, said angle being defined by the following equation:

$$a=584Tl/(D^4-d^4)G$$

wherein

T=the twisting moment in inch-lbs;

l=length of tubing in inches;

D=outside diameter of tubing in inches;

d=inside diameter of tubing in inches;

G=torsional modulus of elasticity;

means for vertically moving said carrier along the length of said pipe; and means for alternating said pressure to oscillate said carrier as it moves vertically along the pipe to clean the pipe.

10. A method for cleaning a pipe, comprising:

providing a non-rotating tubing string;

providing a jet carrier attached to said string, said carrier having a central axis and a plurality of nozzles spaced along its length;

supplying fluid under pressure to said nozzles, said nozzles adapted to expel said fluid against said pipe with a force, said force having an equal and opposite reactive force, one or more of said nozzles being oriented on said carrier such that the reactive force is directionally offset from said carrier axis creating a twisting moment about said axis tending to angularly displace the carrier;

moving said carrier vertically along said pipe;

varying said pressure to oscillate said carrier as it moves vertically along said pipe to clean said pipe.

11. The method of claim 10 wherein said tubing in said tubing string is coiled tubing.

12. The method of claim 10 additionally comprising adding a high molecular weight long chain polymer to said fluid to focus said fluid streams against the pipe.

13. The method of claim 10 wherein said pressure is greater than or equal to about 5,000 psi and less than or equal to about 8,000 psi.

14. The method of claim 10 wherein the number of said nozzles is no less than about 8 and no greater than 16.

15. A method for cleaning pipes, comprising:

providing a non-rotating tubing string;

providing means for expelling a stream of fluid against said pipe, said expelling means being attached to said string;

supplying fluid under pressure to said expelling means;

creating a twisting moment tending to angularly displace said expelling means;

moving said expelling means vertically along said pipe;

varying said pressure to oscillate said expelling means as said expelling means moves along said pipe.

16. A method for cleaning pipes comprising:

providing a non-rotating tubing string;

providing a jet carrier attached to said string having a central axis and having a plurality of nozzles spaced along its length;

supplying fluid under a bottom hole differential pressure, P, to said nozzles, said nozzles having orifices with an area, A, to expel said fluid in streams against said pipe, each of said streams striking said pipe with a force, said force having an equal or opposite reactive force, F, said reactive force being equal to P×A, said nozzle being oriented on said carrier such that the reactive force, F, is offset a distance, B, with respect to the axis of the carrier creating a twisting moment, T, equal to F×B tending to rotate the carrier an angle, a, said angle being defined by the following equation:

$$a=584Tl/(D^4-d^4)G$$

wherein

T=the twisting moment in in.-lbs;

l=length of tubing in inches;

D=outside diameter of tubing in inches;

d=inside diameter of tubing in inches;

G=torsional modulus of elasticity;

moving the carrier vertically along the length of the pipe; and alternating said pressure to oscillate the carrier as it moves vertically along the pipe to clean the pipe.

* * * * *